US005599408A

United States Patent [19]

Fujita et al.

[11] Patent Number: 5,599,408

[45] Date of Patent: Feb. 4, 1997

[54] METHOD OF PRODUCING A STRUCTURAL MEMBER

[75] Inventors: Akitsugu Fujita; Takayuki Kawano, both of Nagasaki; Makoto Nakamura, Tokyo; Fumikazu Sakai, Nagasaki; Tatsuki Matsumoto, Nagasaki; Shinsuke Oba, Nagasaki; Hidetoshi Sueoka, Nagasaki; Manabu Kimura, Nagasaki; Masato Zama, deceased, late of Nishisonogi-gun, all of Japan, by Kasuko Zama, Heiress

[73] Assignee: Mitsubishi Jukogyo Kabushiki Kaisha, Tokyo, Japan

[21] Appl. No.: 232,191

[22] PCT Filed: Aug. 12, 1993

[86] PCT No.: PCT/JP93/01137

§ 371 Date: May 4, 1994

§ 102(e) Date: May 4, 1994

[87] PCT Pub. No.: WO94/05824

PCT Pub. Date: Mar. 17, 1994

[30] Foreign Application Priority Data

Sep. 4, 1992 [JP] Japan ..... 4-263158
Feb. 10, 1993 [JP] Japan ..... 5-022503

[51] Int. Cl.[6] ..... C21D 6/02
[52] U.S. Cl. ..... 148/607
[58] Field of Search ..... 148/607, 326

[56] References Cited

U.S. PATENT DOCUMENTS 3,871,928 3/1975 Smith, Jr. et al. ..... 148/607

FOREIGN PATENT DOCUMENTS 0257780 3/1988 European Pat. Off. .
44-15054 7/1969 Japan .
51-5611 2/1976 Japan .
51-29086 8/1976 Japan .
56-25266 6/1981 Japan .
61-157626 7/1986 Japan ..... 148/607
1-119649 5/1989 Japan .
4191352 9/1992 Japan .
5112849 7/1993 Japan .
PCT/01137 8/1993 Japan .

*Primary Examiner*—Deborah Yee
*Attorney, Agent, or Firm*—Jacobson, Price, Holman & Stern, PLLC

[57] ABSTRACT

ϵ phase precipitates in the matrix having a composition of 0.07% or less carbon, 1 or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron, and comprising 6 to 30 vol % austenitic phase and the balance composed substantially of martensitic phase. In a method of producing a structural member in which first solution treatment is performed at 1010° to 1050° C. on a stainless steel having a composition described above and first aging treatment is performed at a temperature not lower than 520° C. and not higher than 630° C., second solution treatment is performed at 730° to 840° C., and then second aging treatment is performed at a temperature not lower than 520° C. and not higher than 630° C. or a structural member of any shape is fabricated by means of welding work before the second solution treatment. Also, a structural member is produced by performing first solution treatment at 1010° to 1050° C. on a stainless steel having a composition described above, performing aging treatment at a temperature not lower than 520° C. and not higher than 630° C., fabricating a structural member of any shape by means of welding work, heating the material at a rate of 100° C./hour or lower, performing second solution treatment at 1010° to 1050° C., cooling the material in a furnace to room temperature at a cooling rate of 100° C./hour or lower, performing aging treatment at a temperature not lower than 520° C. and not higher than 630° C., and cooling the material in a furnace to room temperature at a cooling rate of 100° C./hour or lower.

14 Claims, 4 Drawing Sheets

(x100)

(x100)

(x300)

METHOD OF PRODUCING A STRUCTURAL MEMBER

TECHNICAL FIELD

The present invention relates to a method of producing the a structural member, such as a hydrofoil of high-speed passenger craft and an offshore oil-related facility, which requires high strength, high toughness, and high corrosion resistance and involves welding work, and a method of producing the same.

BACKGROUND ART

Conventionally, the heat treatment of the above-described structural member is normally carried out by quench-and-temper. After welding is performed, re-solution treatment and aging treatment are carried out.

However, when the above-described re-solution treatment is done, the welded structural member is deformed by residual stress or gravitation. To prevent the deformation, considerably large-scale, firm constraint is required. Even a structural member which does not involve welding has far lower toughness as compared with a member heat-treated in accordance with the present invention.

The present invention was made in view of the above situation. Accordingly, an object of the present invention is to provide a method of producing a structural member in which the deformation occurring during heat treatment is prevented and the toughness is significantly improved.

DISCLOSURE OF THE INVENTION

The inventors eagerly carried out researches to solve the above problems. As a result, we invented a method of producing a new structural member in which the deformation occurring during heat treatment is prevented and the toughness is significantly improved.

Specifically, the present invention has features described in the following items (1) to (15).

(1) A structural member with high toughness and little distortion due to heat treatment, in which $\epsilon$ phase precipitates in the matrix having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron, and comprising 6 to 30 vol % austenitic phase and the balance composed substantially of martensitic phase.

(2) A ship comprising a hull, propulsion equipment installed at the rear of the hull, and hydrofoils which are installed under the hull in the substantially horizontal direction and are made of a stainless steel with a structure in which $\epsilon$ phase precipitates in the matrix having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron, and comprising 6 to 30 vol % austenitic phase and the balance composed substantially of martensitic phase.

(3) A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing first aging treatment at a temperature not lower than 520° C. and not higher than 630° C.; performing second solution treatment at 730° to 840° C.; and performing second aging treatment at a temperature not lower than 520° C. and not higher than 630° C.

(4) A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing first aging treatment at a temperature not lower than 520° C. and not higher than 630° C.; fabricating a structural member of any shape by means of welding work; performing second solution treatment at 730° to 840° C.; and performing second aging treatment at a temperature not lower than 520° C. and not higher than 630° C.

(5) A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum,0.15 to 0.45% niobium, by weight, and the balance composed substantially of iron; performing first aging treatment at a temperature not lower than 520° C. and not higher than 630° C.; heating the material at a rate of 100° C./hour or lower; performing second solution treatment at 730° to 840° C.; cooling the material in a furnace to room temperature at a cooling rate of 100° C./hour or lower; performing second aging treatment at a temperature not lower than 520° C. and not higher than 630° C.; and cooling the material in a furnace to room temperature at a cooling rate of 100° C./hour or lower.

(6) A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing first aging treatment at a temperature not lower than 520° C. and not higher than 630° C.; fabricating a structural member of any shape by means of welding work; heating the material at a rate of 100° C./hour or lower; performing second solution treatment at 730° to 840° C.; cooling the material in a furnace to room temperature at a cooling rate of 100° C./hour or lower; performing second aging treatment at a temperature not lower than 520° C. and not higher than 630° C.; and cooling the material in a furnace to room temperature at a cooling rate of 100° C./hour or lower.

(7) A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing first aging treatment at a temperature not lower than 520° C. and not higher than 630° C.; putting the material into a container formed of metal plates; heating the material together with the container at a rate of 100° C./hour or lower; performing second solution treatment at 730° to 840° C.; cooling the material in a furnace to room temperature at a cooling rate of 100° C./hour or lower; performing second aging treatment at a temperature not lower than 520°

C. and not higher than 630° C.; and cooling the material in a furnace to room temperature at a cooling rate of 100° C./hour or lower.

(8) A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing first aging treatment at a temperature not lower than 520° C. and not higher than 630° C.; fabricating a structural member of any shape by means of welding work; putting the material into a container formed of metal plates; heating the material together with the container at a rate of 100° C./hour or lower; performing second solution treatment at 730° to 840° C; cooling the material in a furnace to room temperature at a cooling rate of 100° C./hour or lower; performing second aging treatment at a temperature not lower than 520° C. and not higher than 630° C.; and cooling the material in a furnace to room temperature at a cooling rate of 100° C./hour or lower.

(9) A method of producing a structural member as described in any one of items (5) to (8) in which when the temperature of the material reaches a temperature between 550° C. and 620° C. in the temperature raising process in the second solution treatment, the material is kept at that temperature for 30 minutes to 2 hours, and after the temperatures at all portions of the material have been uniformed, the temperature is raised to the second solution treatment temperature.

(10) A method of producing a structural member as described in any one of items (5) to (8) in which when the temperature of the material reaches a temperature between 300° C. and 220° C. in the temperature lowering process in the second solution treatment, the material is kept at that temperature for 30 minutes to 2 hours, and after the temperatures at all portions of the material have been uniformed, the temperature is lowered to room temperature.

(11) A method of producing a structural member as described in item (9) in which when the temperature of the material reaches a temperature between 300° C. and 220° C. in the temperature lowering process in the second solution treatment, the material is kept at that temperature for 30 minutes to 2 hours, and after the temperatures at all portions of the material have been uniformed, the temperature is lowered to room temperature.

(12) A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing aging treatment at a temperature not lower than 520° C. and not higher than 630° C.; fabricating a structural member of any shape by means of welding work; heating the material at a rate of 100° C./hour or lower; performing second solution treatment at 1010° to 1050° C.; cooling the material in a furnace to room temperature at a cooling rate of 100° C./hour or lower; performing aging treatment at a temperature not lower than 520° C. and not higher than 630° C.; and cooling the material in a furnace to room temperature at a cooling rate of 100° C./hour or lower.

(13) A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing aging treatment at a temperature not lower than 520° C. and not higher than 630° C.; fabricating a structural member of any shape by means of welding work; putting the material into a container formed of metal plates; heating the material together with the container at a rate of 100° C./hour or lower; performing second solution treatment at 1010° to 1050° C.; cooling the material in a furnace to room temperature at a cooling rate of 100° C./hour or lower; performing aging treatment at a temperature not lower than 520° C. and not higher than 630° C.; and cooling the material in a furnace to room temperature at a cooling rate of 100° C./hour or lower.

(14) A method of producing a structural member as described in item (12) or (13) in which when the temperature of the material reaches a temperature between 550° C. and 620° C. in the temperature raising process in the second solution treatment, the material is kept at that temperature for 30 minutes to 2 hours, and after the temperatures at all portions of the material have been uniformed, the temperature is raised to the second solution treatment temperature.

(15) A method of producing a structural member as described in any one of items (12) to (14) in which when the temperature of the material reaches a temperature between 300° C. and 220° C. in the temperature lowering process in the second solution treatment, the material is kept at that temperature for 30 minutes to 2 hours, and after the temperatures at all portions of the material have been uniformed, the temperature is lowered to room temperature.

The inventors have obtained a welded structural member which is not deformed in heat treatment and has excellent material properties which has not been obtained before by rigidly selecting the heat treatment conditions of precipitation hardening martensitic stainless steel, which is the subject of the present invention. The reasons for limitation of the present invention will be described below.

The alloy composition which is the subject of the present invention is as follows:

(Carbon): When the content exceeds 0.07%, the martensite in the matrix is hardened, so that the material becomes hard and brittle. Therefore, the carbon content is set equal to 0.07% or less.

(Silicon): Silicon is a deoxidizer, and acts effectively when the content is 1% or less. When the content exceeds 1%, the material becomes brittle. Therefore, the silicon content is set equal to 1% or less.

(Manganese): Manganese is also a deoxidizer, and acts effectively when the content is 1% or less. When the content exceeds 1%, the toughness is lowered, and the martensite in the matrix becomes unstable. Therefore, the manganese content is set equal to 1% or less.

(Copper): Copper precipitates finely as an intermetallic compound in aging, so that it improves the strength of material. When the content is less than 2.5%, the effect is insufficient, while when the content exceeds 5%, the toughness is lowered. Therefore, the copper content is set equal to 2.5 to 5%.

(Nickel): Nickel dissolves in the matrix, and yields an intermetallic compound together with copper. When the nickel content is less than 3%, delta ferrite in the matrix precipitates, resulting in lowered toughness and ductility. When the content exceeds 5.5%, retained austenite exists in the matrix at ordinary temperatures, so that sufficient strength cannot be obtained. Therefore, the nickel content is set equal to 3 to 5.5%.

(Chromium): Chromium is an indispensable element for maintaining corrosion resistance, and a principal element of the material of the present invention. When the content is less than 14%, sufficient corrosion resistance cannot be obtained. When the content exceeds 17.5%, delta ferrite precipitates. Therefore, the chromium content is set equal to 14 to 17.5%.

(Molybdenum): Molybdenum is an element which is effective in providing pitting resistance. However, when the content exceeds 0.5%, the material becomes brittle. Therefore, the molybdenum content is set equal to 0.5% or less.

(Niobium): Niobium makes the crystal grain size fine, being effective in improving strength, ductility, and toughness. When the content is less than 0.15%, the effectiveness is insufficient. When the content exceeds 0.45%, niobium crystallizes in large amounts as carbide in solidification, resulting in lowered ductility and toughness. Therefore, the niobium content is set equal to 0.15 to 0.45%. The balance is composed substantially of iron, which is the basic element of stainless steel.

Further, the structural member of the present invention as described in the aforesaid item (1) or (2) has the following structure in addition to the above composition.

(Austenitic phase): Austenitic phase is produced in the martensitic phase of matrix as a reverted austenitic phase. The property of austenitic phase itself having high toughness improves the toughness of the whole matrix. In addition, the precipitation of austenitic phase in martensitic phase provides a combined effect that the grains of martensite is made fine, by which the toughness is further improved. The percentage of austenitic phase less than 6 vol % provides an insufficient increase in toughness, while that exceeding 30% provides insufficient strength of matrix. Therefore, the percentage of austenitic phase is set equal to 6 to 30 vol %. The percentage of 10 to 25 vol % is preferable.

(Martensitic phase): Martensitic phase is the basic structure composing the matrix of the member of the present invention, providing basic characteristics of matrix, such as mechanical properties.

($\epsilon$ phase): $\epsilon$ phase precipitates finely in the matrix of the member of the present invention, strengthening the member of the present invention.

Next, the producing method (heat treatment method) of the present invention will be described.

The first solution treatment and aging treatment are the normal heat treatment process for the material which is the subject of the present invention. This process is the same as specified as the heat treatment process for SUS630 in JIS G4303. In this heat treatment process, solution elements existing in a steel is once dissolved in the matrix by solution treatment at 1010° to 1050° C., microscopic segregation (biased arrangement of components) is corrected, and then copper-rich intermetallic compound ($\epsilon$ phase) is precipitated by aging treatment at 520° to 630° C., by which a high-strength material can be obtained.

In the present invention described in the above items (3) to (11), the second solution treatment and aging treatment are particularly important points. These treatments give high toughness to the base material and homogeneous mechanical properties and high toughness to the weld. In addition, the second solution treatment temperature lower than the first solution treatment temperature and the control of the temperature increase/decrease rate in the heat treatment enable the deformation of material due to heat treatment to be kept at a very low value.

Welding is performed after the first solution treatment and aging treatment or after the first solution treatment. At this time, the weld metal zone and the heat-affected zone constitute a portion where the heat treatment which should be used intrinsically for this material is not performed (weld metal zone) or a portion where the heat treatment which has been performed before is entirely canceled (heat treatment zone). Therefore, necessary strength and toughness and other various properties are impaired, so that it is necessary to carry out heat treatment again.

Thus, the second solution treatment is carried out. The temperature for this treatment is 730° to 840° C. This treatment can be performed while maintaining the strength of material, unlike ordinary solution treatment. Therefore, even if this heat treatment is performed on a particularly large welded structural member, the deformation is less than that in the first solution treatment, and the heat treatment can be easily performed on the product. In the heat treatment of the present invention, the solution treatment at low temperatures as described above is used to keep the deformation in heat treatment at a lowest possible value, and the temperature difference at the portions of material is reduced by controlling the temperature in heat treatment, which can significantly decrease the deformation of material. The temperature control method in accordance with the present invention will be described later. The second solution treatment and the second aging treatment provide the material with very high toughness which cannot be obtained by the ordinary heat treatment process.

The as-weld weld portion has a softened area in the heat-affected zone (HAZ). This is because aging precipitation proceeds by the fact that the weld portion is kept at a high temperature by welding, by which overaging softening (a phenomenon in which precipitation of intermetallic compound proceeds, and the precipitate coagulates and becomes coarse, thereby the strength being decreased) occurs. In this case, a crack is created in this weak heat-affected zone in service at an earlier time than the intrinsic life of this member, resulting in the failure of the member. To eliminate such a trouble, re-solution treatment is usually performed. This ordinary re-solution treatment is performed at the same temperature as that of the first solution treatment of the present invention. In this case, because the member is kept at a high temperature as described above, deformation occurs owing to the residual stress of welding or the stress due to gravitation, so that it is difficult to make the correct shape of product.

The solution treatment after welding, or the second solution treatment, in accordance with the present invention, is performed at a far lower heat treatment temperature than the first solution treatment temperature. Therefore, heat treatment can be carried out with less deformation than the first solution treatment. Also, since this solution treatment temperature exceeds the Ac3 transformation point (a temperature at which the whole structure transforms from martensitic phase, which is a low-temperature phase, to austenitic phase, which is a high-temperature phase), almost all solution elements are dissolved, so that the effect equivalent to that of solution treatment can be achieved. However, since this temperature is low for the solution treatment temperature, the diffusion of solution elements which are dissolved from the precipitate is insufficient, so that microscopic segregation remains. Since this microscopic segregation is rich in copper and nickel, which are austenitic phase producing elements, austenite transformation occurs at a temperature lower than the average Ac1 transformation temperature of the whole material in aging treatment in the subsequent process (called reverted austenite), which contributes to the improvement in toughness.

The aforesaid austenitic phase has high corrosion resistance and does not entail the deterioration of corrosion resistance at the boundary between austenitic and martensitic phases. Therefore, there is no problem even if the member is used in a corrosive environment such as in sea water. If this second solution treatment is performed at a temperature exceeding 840° C., a large structural member entails remarkable deformation during heat treatment, so that large restraining jigs are needed, which leads to higher cost due to increased manpower and increased work period. If the second solution treatment is performed at a temperature lower than 730° C., sufficient dissolution of solution elements, which is necessary for solution treatment, cannot be performed. For this reason, the temperature for the second solution treatment is limited to 730° to 840° C.

The second aging treatment is performed to obtain proper strength by precipitating the solution elements, in which quench martensitic structure is changed into temper martensitic structure by the second solution treatment and which is dissolved, as a copper- and nickel-rich intermetallic compound called $\epsilon$ phase. Also, this heat treatment produces reverted austenite as described above, which enables high toughness to be obtained. If the aging treatment temperature exceeds 630° C., overaging softening occurs, so that the strength is lowered; therefore, necessary sufficient strength cannot be obtained. If the aging treatment temperature is lower than 520° C., insufficient aging precipitation provides strength higher than necessary strength, resulting in a decrease in ductility.

The aim of the present invention described in the above-described items (12) to (15) is to provide a heat treatment method in which after the material obtained as described above is formed into an intended shape by welding, subsequent heat treatment is performed with the deformation being as low as possible. When such a precipitation hardening material is welded, part of the heat-affected zone of the welded portion is kept at a high temperature, so that the precipitated solution elements dissolves in the matrix, or the precipitation proceeds, resulting in decreased strength. Also, at a part of the heat-affected zone, transformation takes place from martensitic phase (low-temperature phase) to austenitic phase (high-temperature phase) in welding, and the part changes into quench martensitic structure after welding. This quench martensitic structure, having low corrosion resistance, is prone to form stress corrosion cracking in a corrosive environment such as in sea water. As described above, the material which is the subject of the present invention requires heat treatment after welding because it contains a softened zone or a less corrosion-resistant zone in the as-weld condition. After welding work is completed, therefore, solution treatment and aging treatment are performed under the same conditions as those of the first heat treatment used on the material. This provides mechanical properties equivalent to those of the material. However, in the case where materials having different thicknesses are fabricated into a welded structure, when heat treatment which causes structure transformation, such as solution treatment, is performed, the welded structure is deformed by the expansion/shrinkage due to transformation.

With the heat treatment method of the present invention, a temperature control method described below is used to prevent the deformation.

The reasons for limitation in the temperature control method, which is the second point of the present invention, will be described below.

Usually, with the heat treatment method of the material which is the subject of the present invention, the rate of temperature increase and decrease is not specified in solution treatment and aging treatment. Therefore, temperature is raised rapidly to save fuel cost, or cooling is performed at a relatively high rate, such as by quenching using water or oil or by air cooling. However, the structural member which is the main subject of the present invention is often a welded structure. Even when it is not a welded structure, it is sometimes a large structure of a small thickness. There is, therefore, a disadvantage that a predetermined shape cannot be kept when temperature is changed rapidly. According to the present invention, as described above, heat treatment is performed at a temperature lower than before in the second solution treatment to prevent deformation of a structural member, and the rate of temperature increase and decrease is specified so that the temperature difference at portions of material is minimized to prevent deformation of a structural member. At this time, if heat treatment is performed at a high rate of temperature increase and decrease exceeding 100° C./hour, remarkable deformation due to heat treatment is caused even in the second solution treatment in which the heating temperature is lower than before. Therefore, the rate of temperature increase and decrease should be 100° C./hour or lower.

When a material being heat-treated is put directly into a heating furnace, the material, if being large, is heated locally by the radiant heat from the heating furnace. To prevent the local heating of material due to radiant heat, the material is wrapped in a metal plate (called a muffle), and the whole of muffle is heated. This reduces the temperature difference, by which the deformation of material is further prevented. The use of a muffle can prevent not only the radiant heat in the temperature increasing process but also local cooling due to air blast from the outside of the furnace in cooling, by which the temperature difference at portions of material can be kept at a very low value.

Further, according to the present invention, the retention of temperature is performed in an intermediate point during temperature increase and decrease, by which the temperature difference at portions of material caused by the preceding change in temperature is corrected. This enables the deformation due to the volume change accompanying structure transformation to be kept at a minimum. In the temperature increasing process, there is the Ac1 transformation point (the temperature at which high-temperature austenitic phase begins to appear in low-temperature martensitic phase) near 650° C., and this transformation causes volumetric shrinkage. At this time, if the temperature difference at potions of material is large, there appears a difference in volumetric change between the transformed portion and the non-transformed portion, which is applied to the material itself as a stress, resulting in deformation. For this reason, the temperature increase is once stopped at a temperature of 550° to 620° C., which is below the transformation start temperature, and then the temperature increase in the subsequent process is restarted after the temperatures at portions of material have been uniformed. At this time, if the retention temperature is lower than 550° C., a temperature difference occurs at the portions of material during the time when the temperature increases to the transformation temperature, so that the effect of temperature retention sometimes cannot be achieved. If the temperature retention is performed at a temperature exceeding 620° C., some components of the present invention exceeds Ac1 transformation point. Therefore, it is preferable that the retention temperature in temperature increase be 550° to 620° C. In the temperature decreasing process, there is the Ms transformation point (the temperature at which low-temperature martensitic phase begins to appear in high-temperature austenitic phase) near 200° C., and this transformation causes volumetric expansion. At this time, if the temperature difference at potions of material is large in temperature decrease as in temperature increase, there appears a difference in volumetric change between the transformed portion and the non-transformed portion, which is applied to the material itself as a stress, resulting in deformation. For this reason, the temperature decrease is once stopped at a temperature of 300° to 220° C., which is higher than the transformation start temperature, and then the temperature decrease in the subsequent process is restarted after the temperatures at portions of material have been uniformed. At this time, if the retention temperature is higher than 300° C., a temperature difference occurs at the portions of material during the time when the temperature decreases to the transformation temperature, so that the effect of temperature retention sometimes cannot be achieved. If the temperature retention is performed at a temperature lower than 220° C., some components of the present invention exceeds the Ms transformation point, so that the effect of temperature retention sometimes cannot be achieved. Therefore, it is preferable that the retention temperature in temperature decrease be 300° to 220° C.

BEST MODE FOR CARRYING OUT THE INVENTION

One embodiment of the present invention will be described below.

(Material)

A material having a composition given in Table 1 below was melted in a 25-ton electric furnace, refined in a 30-ton ladle refining furnace, and made into an electrode for secondary melting by the bottom pouring method. Then, the material was remelted in an electroslag remelting furnace (ESR furnace) to make a material for forging. After that, it was forged into a 65 mm-thick plate to be subjected to tests.

For the heat treatment of the material, the first solution treatment was performed at 1040° C. for one hour, and then the aging treatment was performed at 595° C. for four hours. Hereinafter, the material which was subjected to the above treatment was called "the material being tested".

TABLE 1

| | (wt. %) BALANCE Fe | | | | | | | |
|---|---|---|---|---|---|---|---|---|
| | C | Si | Mn | Cu | Ni | Cr | Mo | Nb |
| ANALYTICAL VALUE | 0.03 | 0.25 | 0.46 | 3.38 | 4.60 | 14.57 | 0.12 | 0.33 |

(Experiment 1)

The mechanical properties of the material being tested which was thus obtained are given in Table 2 below.

TABLE 2

| NORMAL-TEMPERATURE TENSILE TEST | | | | IMPACT TEST |
|---|---|---|---|---|
| 0.2% PROOF TEST (kgf/mm$^2$) | TENSILE STRENGTH (kgf/mm$^2$) | ELONGATION (%) | REDUCTION OF AREA (%) | IMPACT VALUE (kgf-m/cm$^2$) |
| 99.8 | 105.5 | 20.1 | 68.3 | 17.0 |
| 97.6 | 104.3 | 21.2 | 64.1 | 15.3 |

Figure 1:
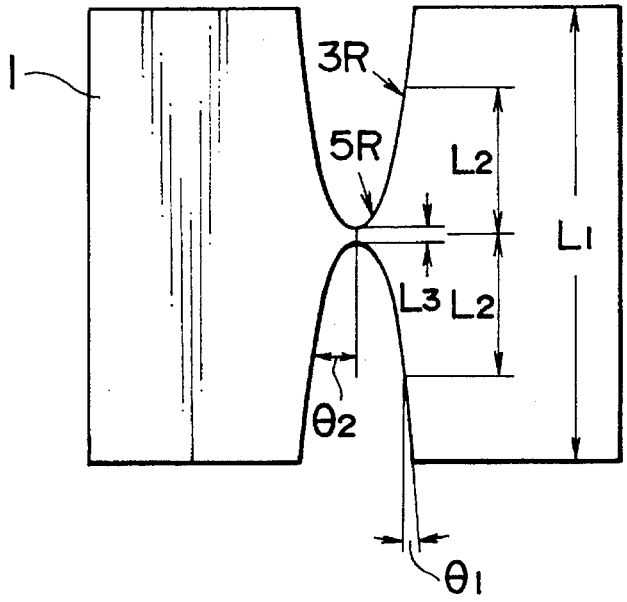
FIG. 1 is a view illustrating a groove shape before welding of a TIG welding test piece which is used in the embodiment of the present invention.

A groove shape shown in FIG. 1 was formed on the material being tested 1, and TIG welding was performed under the welding conditions given in Table 3 below to obtain a welded joint. In FIG. 1, $L_1$ is 65 mm, $L_2$ is 20 mm, $L_3$ is 0.5 mm, $\theta_1$ is 5° , $\theta_2$ is 20°.

TABLE 3

| WELDED SURFACE | LAYER | WELDING CURRENT (A) | ARC VOLTAGE (V) |
|---|---|---|---|
| FACE | 1ST LAYER | 90 | 9 |
| | 2ND LAYER | 110 ~ 120 | 9.5 |
| | 3RD LAYER ~ FINISHING LAYER | 130 | 9.5 |
| BACK | 1ST LAYER ~ FINISHING LAYER | 130 | 9.5 |

SHIELDING GAS: Ar 15 l/min
INTERLAYER TEMPERATURE: 100 ~ 150° C.

The welded joint thus obtained was subjected to the second solution treatment and aging treatment, and then a mechanical property test was carried out. The obtained test results are shown in Tables 4 and 5 below. In the second solution treatment and aging treatment in this test, heating and cooling were not controlled; rapid heating and air cooling were performed.

TABLE 4

| 2ND SOLUTION TREATMENT (°C.) | AGING TREAT-MENT (°C.) | POSITION | NORMAL-TEMPERATURE TENSILE TEST 0.2% PROOF STRESS (kgf/mm²) | TENSILE STRESS (kgf/mm²) | ELONGA-TION (%) | REDUC-TION OF AREA (%) | BREAKING POSITION | * INPACT VALUE (kgf/m) |
|---|---|---|---|---|---|---|---|---|
| | | HEAT-TREATED MATERIAL OF THE PRESENT INVENTION | | | | | | |
| 760 | 560 | BASE | 88.5 | 95.2 | 25.2 | 73.9 | — | 31.8 |
| | | METAL | 86.3 | 93.8 | 26.0 | 74.7 | | 33.9 |
| | | WELDED JOINT | 88.4 | 95.0 | 23.6 | 73.9 | BASE METAL | 32.5 |
| | 580 | BASE | 81.6 | 90.8 | 26.0 | 74.8 | — | 32.0 |
| | | METAL | 80.7 | 90.6 | 26.0 | 73.5 | | 32.1 |
| | | WELDED JOINT | 82.2 | 91.6 | 23.6 | 74.1 | BASE METAL | 34.1 |
| | 600 | BASE | 72.8 | 88.1 | 27.6 | 74.6 | — | 34.8 |
| | | METAL | 70.6 | 87.5 | 28.4 | 75.9 | | 33.5 |
| | | WELDED JOINT | 71.5 | 88.4 | 24.8 | 75.1 | BASE METAL | 36.0 |
| 800 | 560 | BASE | 90.3 | 96.1 | 25.6 | 74.6 | — | 29.0 |
| | | METAL | 93.4 | 98.3 | 24.8 | 74.2 | | 31.8 |
| | | WELDED JOINT | 91.6 | 96.5 | 20.8 | 77.3 | WELD METAL | 34.6 |
| | 580 | BASE | 84.8 | 93.1 | 26.4 | 76.1 | — | 31.3 |
| | | METAL | 84.8 | 92.7 | 26.0 | 74.8 | | 33.5 |
| | | WELDED JOINT | 83.4 | 92.1 | 22.8 | 80.1 | WELD METAL | 35.4 |
| | 600 | BASE | 73.4 | 88.6 | 25.2 | 73.8 | — | 34.1 |
| | | METAL | 74.0 | 88.6 | 27.2 | 76.1 | | 33.9 |
| | | WELDED JOINT | 71.4 | 89.0 | 25.2 | 75.1 | BASE METAL | 34.1 |
| 840 | 560 | BASE | 98.2 | 102.1 | 24.0 | 72.6 | — | 27.0 |
| | | METAL | 98.6 | 102.2 | 23.2 | 72.0 | | 27.6 |
| | | WELDED JOINT | 98.5 | 101.6 | 21.2 | 77.1 | WELD METAL | 29.9 |
| | 580 | BASE | 91.3 | 96.8 | 24.8 | 73.9 | — | 29.8 |
| | | METAL | 91.5 | 96.6 | 24.8 | 73.5 | | 30.4 |
| | | WELDED JOINT | 91.3 | 96.3 | 22.0 | 77.2 | WELD METAL | 32.0 |
| | 600 | BASE | 80.3 | 91.7 | 26.0 | 74.5 | — | 31.9 |
| | | METAL | 79.9 | 91.9 | 25.6 | 74.5 | | 33.0 |
| | | WELDED JOINT | 78.7 | 92.0 | 26.0 | 74.0 | BASE METAL | 24.6 |

*: The impact test on weld was performed with a notch being formed on the heat-affected zone (HAZ).

TABLE 5

| 2ND SOLUTION TREATMENT (°C.) | AGING TREAT-MENT (°C.) | POSITION | NORMAL-TEMPERATURE TENSILE TEST 0.2% PROOF STRESS (kgf/mm²) | TENSILE STRESS (kgf/mm²) | ELONGA-TION (%) | REDUC-TION OF AREA (%) | BREAKING POSITION | * INPACT VALUE (kgf/m) |
|---|---|---|---|---|---|---|---|---|
| | | REFERENCE HEAT-TREATED MATERIAL | | | | | | |
| 800 | 500 | BASE | 115.6 | 120.4 | 11.5 | 51.2 | — | 9.5 |
| | | METAL | 117.8 | 121.4 | 10.4 | 50.4 | | 10.2 |
| | 640 | WELDED JOINT | 51.3 | 69.8 | 27.2 | 79.2 | BASE METAL | 30.4 |
| 900 | 560 | BASE | 100.8 | 108.4 | 19.4 | 68.7 | — | 14.7 |
| | | METAL | 97.9 | 107.6 | 18.7 | 66.8 | | 15.9 |
| | | WELDED | 106.9 | 111.3 | 20.5 | 65.4 | BASE METAL | 15.6 |
| | | JOINT | 105.9 | 110.8 | 19.8 | 66.9 | BASE METAL | 14.7 |
| | 580 | BASE | 95.2 | 103.6 | 23.5 | 70.2 | — | 15.5 |
| | | METAL | 96.3 | 105.2 | 21.6 | 68.9 | | 14.9 |
| | | WELDED | 102.6 | 107.3 | 21.2 | 69.8 | BASE METAL | 14.3 |
| | | JOINT | 101.5 | 108.2 | 22.5 | 70.4 | BASE METAL | 18.9 |
| | 600 | BASE | 87.5 | 97.4 | 22.8 | 69.5 | — | 19.1 |
| | | METAL | 86.9 | 97.3 | 22.0 | 66.1 | | 20.1 |
| | | WELDED | 93.3 | 99.6 | 24.0 | 70.3 | BASE METAL | 18.6 |
| | | JOINT | 93.0 | 99.5 | 23.6 | 69.5 | BASE METAL | 17.6 |
| 1040 | 560 | BASE | 110.6 | 115.5 | 18.9 | 65.5 | — | 11.8 |
| | | METAL | 110.3 | 114.9 | 19.9 | 68.9 | | 8.9 |
| | | WELDED | 115.4 | 126.3 | 20.8 | 64.3 | BASE METAL | 12.3 |
| | | JOINT | 114.9 | 127.9 | 21.2 | 62.2 | BASE METAL | 10.1 |
| | 580 | BASE | 105.1 | 108.5 | 18.7 | 66.9 | — | 14.8 |
| | | METAL | 104.5 | 107.2 | 19.6 | 68.1 | | 10.9 |
| | | WELDED | 110.2 | 115.8 | 17.3 | 66.5 | BASE METAL | 14.9 |
| | | JOINT | 111.3 | 116.1 | 18.9 | 65.3 | BASE METAL | 12.5 |

TABLE 5-continued

| 2ND SOLUTION TREATMENT (°C.) | AGING TREAT-MENT (°C.) | POSITION | NORMAL-TEMPERATURE TENSILE TEST 0.2% PROOF STRESS (kgf/mm²) | TENSILE STRESS (kgf/mm²) | ELONGA-TION (%) | REDUC-TION OF AREA (%) | BREAKING POSITION | * INPACT VALUE (kgf/m) |
|---|---|---|---|---|---|---|---|---|
| | 600 | BASE | 99.4 | 104.9 | 22.2 | 67.9 | — | 17.0 |
| | | METAL | 102.1 | 106.9 | 21.8 | 68.9 | | 17.6 |
| | | WELDED | 104.3 | 108.5 | 22.5 | 66.9 | BASE METAL | 16.6 |
| | | JOINT | 104.1 | 108.9 | 24.1 | 70.1 | BASE METAL | 17.6 |

*: The impact test on weld was performed with a notch being formed on the heat-affected zone (HAZ).

As seen from Tables 4 and 5 shown above, the test piece heat-treated by the method of the present invention stably provides high toughness as compared with the reference material. Therefore, the heat treatment method of the present invention can be said to be excellent.

(Experiment 2)

Two 500 mm-long, 200 mm-wide, and 27 mm-thick plates of the material being tested were butted against each-other at their long edges, and electron beam welding was performed under the conditions of a beam current of 160 mmA, an accelerating voltage of 70 KV, a convergent current of 1205 mmA, and a welding speed of 200 mm/min to obtain a welded joint. After the same second solution treatment and aging treatment as those in the above example were performed, a mechanical property test was carried out. The test results are given in Table 6 below.

These test results also reveal that the test piece on which the heat treatment method (producing method) of the present invention is used stably provides high toughness as seen from the impact values. Therefore, the heat treatment method of the present invention can be said to be excellent.

(Experiment 3)

In order to relieve heat treatment strain caused by heating and cooling in heat treatment, the material being tested was heat-treated and welded in the same manner as the aforesaid experiment while controlling the temperature increasing and decreasing rates in the second solution treatment and aging treatment with a target rate of 50° C./hour. The welded member thus obtained was subjected to the same mechanical tests as in the aforesaid experiment. The test results are given in Table 7 below.

TABLE 6

| 2ND SOLUTION TREATMENT (°C.) | AGING TREAT-MENT (°C.) | POSITION | NORMAL-TEMPERATURE TENSILE TEST 0.2% PROOF STRESS (kgf/mm²) | TENSILE STRESS (kgf/mm²) | ELONGA-TION (%) | REDUC-TION OF AREA (%) | BREAKING POSITION | * INPACT VALUE (kgf/m) |
|---|---|---|---|---|---|---|---|---|
| | | HEAT-TREATED MATERIAL OF THE PRESENT INVENTION | | | | | | |
| 760 | 560 | BASE | 87.2 | 94.2 | 25.4 | 78.9 | — | 32.0 |
| | | METAL | 85.5 | 92.9 | 25.8 | 75.3 | | 32.8 |
| | | WELDED JOINT | 88.9 | 94.3 | 24.7 | 77.8 | BASE METAL | 32.4 |
| | 580 | BASE | 82.6 | 91.7 | 27.0 | 75.7 | — | 32.0 |
| | | METAL | 81.5 | 91.4 | 28.3 | 74.6 | | 33.2 |
| | | WELDED JOINT | 83.4 | 91.5 | 23.5 | 74.8 | BASE METAL | 34.5 |
| | 600 | BASE | 75.3 | 90.4 | 26.6 | 78.6 | — | 32.2 |
| | | METAL | 72.5 | 88.5 | 27.3 | 75.2 | | 31.5 |
| | | WELDED JOINT | 72.4 | 89.1 | 23.6 | 75.5 | BASE METAL | 34.0 |
| 820 | 560 | BASE | 95.4 | 98.2 | 24.5 | 74.8 | — | 30.0 |
| | | METAL | 96.2 | 99.4 | 24.8 | 76.8 | | 30.8 |
| | | WELDED JOINT | 95.3 | 99.5 | 22.5 | 77.4 | BASE METAL | 34.2 |
| | 580 | BASE | 88.8 | 94.3 | 26.4 | 74.8 | — | 31.5 |
| | | METAL | 89.1 | 95.2 | 28.8 | 76.4 | | 33.6 |
| | | WELDED JOINT | 87.8 | 94.4 | 23.4 | 80.2 | BASE METAL | 32.4 |
| | 600 | BASE | 77.6 | 90.5 | 24.4 | 73.6 | — | 34.8 |
| | | METAL | 77.2 | 90.7 | 25.8 | 76.8 | | 32.3 |
| | | WELDED JOINT | 76.5 | 91.0 | 27.4 | 75.2 | BASE METAL | 34.1 |
| | | REFERENCE HEAT-TREATED MATERIAL | | | | | | |
| 1040 | 560 | BASE | 110.2 | 115.4 | 24.4 | 70.6 | — | 10.8 |
| | | METAL | 111.4 | 114.8 | 25.6 | 71.5 | | 9.4 |
| | | WELDED JOINT | 114.5 | 122.5 | 21.8 | 76.2 | BASE METAL | 10.1 |
| | 580 | BASE | 104.1 | 109.4 | 24.8 | 74.2 | — | 11.2 |
| | | METAL | 105.3 | 108.4 | 24.0 | 73.0 | | 12.3 |
| | | WELDED JOINT | 110.3 | 116.8 | 22.2 | 78.0 | BASE METAL | 10.2 |
| | 600 | BASE | 99.5 | 105.5 | 26.2 | 74.0 | — | 9.8 |
| | | METAL | 102.6 | 106.3 | 25.6 | 74.6 | | 11.4 |
| | | WELDED JOINT | 104.4 | 108.9 | 26.5 | 74.0 | BASE METAL | 14.2 |

*: The impact test on weld was performed with a notch being formed on the heat-affected zone (HAZ).

TABLE 7

| 2ND SOLUTION TREATMENT (°C.) | 2ND AGING TREATMENT (°C.) | POSITION | NORMAL-TEMPERATURE TENSILE TEST 0.2% PROOF STRESS (kgf/mm²) | TENSILE STRESS (kgf/mm²) | ELONGATION (%) | REDUCTION OF AREA (%) | BREAKING POSITION | * INPACT VALUE (kgf/m) |
|---|---|---|---|---|---|---|---|---|
| | | HEAT-TREATED MATERIAL OF THE PRESENT INVENTION | | | | | | |
| 750 | 560 | BASE | 85.2 | 92.1 | 24.2 | 74.4 | — | 27.6 |
| | | METAL | 85.1 | 90.4 | 22.2 | 71.1 | | 28.8 |
| | | WELDED JOINT | 85.5 | 92.5 | 23.4 | 72.6 | BASE METAL | 29.9 |
| | 580 | BASE | 77.2 | 87.2 | 26.2 | 74.6 | — | 27.4 |
| | | METAL | 76.9 | 87.5 | 26.4 | 74.5 | | 28.4 |
| | | WELDED JOINT | 78.3 | 88.6 | 26.0 | 74.8 | BASE METAL | 30.2 |
| | 600 | BASE | 69.8 | 85.1 | 27.8 | 75.6 | — | 29.9 |
| | | METAL | 69.5 | 84.5 | 27.8 | 74.9 | | 28.3 |
| | | WELDED JOINT | 70.1 | 85.2 | 26.2 | 75.5 | BASE METAL | 30.1 |
| 790 | 560 | BASE | 88.3 | 93.2 | 24.8 | 74.8 | — | 27.4 |
| | | METAL | 90.1 | 95.4 | 25.2 | 75.4 | | 28.8 |
| | | WELDED JOINT | 89.2 | 93.2 | 21.8 | 78.4 | WELD METAL | 29.9 |
| | 580 | BASE | 82.5 | 91.1 | 26.6 | 77.2 | — | 28.4 |
| | | METAL | 81.9 | 90.6 | 27.8 | 77.4 | | 29.9 |
| | | WELDED JOINT | 81.1 | 90.1 | 22.6 | 79.8 | WELD METAL | 32.1 |
| | 600 | BASE | 71.4 | 86.5 | 26.1 | 74.2 | — | 30.3 |
| | | METAL | 71.8 | 86.4 | 26.5 | 75.5 | | 30.1 |
| | | WELDED JOINT | 69.9 | 86.8 | 24.8 | 76.2 | BASE METAL | 29.9 |
| 860 | 560 | BASE | 95.2 | 99.4 | 24.2 | 72.4 | — | 25.3 |
| | | METAL | 95.8 | 99.6 | 24.4 | 72.2 | | 25.5 |
| | | WELDED JOINT | 95.1 | 98.6 | 21.4 | 77.7 | WELD METAL | 28.8 |
| | 580 | BASE | 88.4 | 93.4 | 24.6 | 74.4 | — | 28.4 |
| | | METAL | 88.4 | 93.3 | 24.6 | 74.2 | | 29.2 |
| | | WELDED JOINT | 88.6 | 93.2 | 20.4 | 75.5 | WELD METAL | 30.5 |
| | 600 | BASE | 77.7 | 87.6 | 23.1 | 72.2 | — | 27.6 |
| | | METAL | 76.8 | 88.8 | 25.8 | 74.6 | | 29.4 |
| | | WELDED JOINT | 75.2 | 89.1 | 26.2 | 74.8 | BASE METAL | 30.2 |

*: The impact test on weld was performed with a notch being formed on the heat-affected zone (HAZ).
**: Heat treatment was performed at a rate of 50° C. in both temperature increase and decrease.

As seen from Table 7 shown above, far higher toughness can be obtained than the conventional material, and equivalent properties can be obtained as compared with the materials given in Tables 4 and 6.

(Experiment 4)

Figure 2:
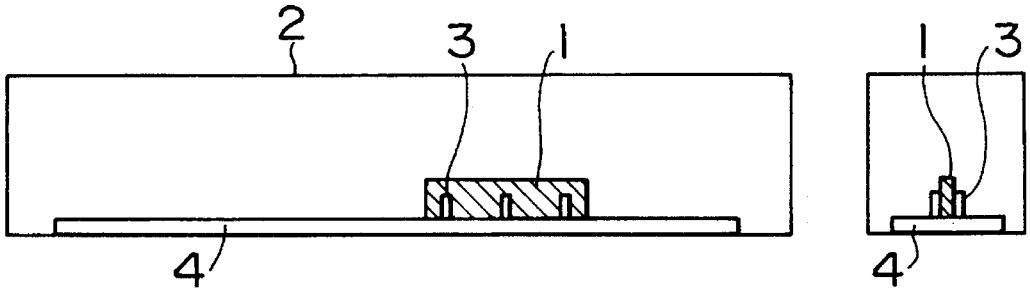
FIG. 2 is a view showing the shape of muffle of the embodiment of the present invention.

Further, in order to reduce heat treatment strain on a large member, the material being tested was formed into a 3 m-long, 50 cm-wide, and 60 mm-thick plate, and the plate was put into a 580 cm-wide, 4 m-high, and 25 m-deep oil-burning heating furnace to perform the second solution treatment and the second aging treatment. The deformation of material was measured before and after the heat treatment. The measurement results are given in Table 8 below. The muffle in the table means a container which is formed of metal plates. In this experiment, a muffle 2 measuring 2 m by 2 m by 15 m which was made of JIS SUS304 stainless steel, as shown in FIG. 2, was used, and a base 4 was installed in the muffle 2. The test piece 1 was fixed by being put between test piece holding jigs 3.

The test piece measured 3 m long, 600 mm wide, and 50 mm thick. The deformation δ in the plate thickness direction from 1*a* before the second solution treatment and aging treatment to 1*b* after the treatment (refer to FIG. 3) was measured. The measurement results are given in Table 8 below.

TABLE 8

| | HEAT TREATMENT CONDITIONS TEMPERATURE INCREASING /DECREASING RATE (°C./hour) | MUFFLE | TEMPERATURE RETENTION IN TEMPERATURE INCREASE* | TENPERATURE RETENTION IN TEMPERATURE DECREASE** | DEFORMATION δ*** (mm) |
|---|---|---|---|---|---|
| REFERENCE HEAT | 150 | ABSENT | NOT PERFORMED | NOT PERFORMED | 5.6 |
| TREATMENT | 250 | ABSENT | NOT PERFORMED | NOT PERFORMED | 21.5 |
| HEAT | 50 | ABSENT | NOT PERFORMED | NOT PERFORMED | 2.5 |
| TREATMENT OF | 50 | ABSENT | PERFORMED | NOT PERFORMED | 2.0 |
| THE PRESENT | 50 | ABSENT | NOT PERFORMED | PERFORMED | 2.3 |
| INVENTION | 50 | ABSENT | PERFORMED | PERFORMED | 1.8 |
| | 50 | PRESENT | NOT PERFORMED | NOT PERFORMED | 1.5 |

TABLE 8-continued

| HEAT TREATMENT CONDITIONS | | | | |
|---|---|---|---|---|
| TEMPERATURE INCREASING /DECREASING RATE (°C./hour) | MUFFLE | TEMPERATURE RETENTION IN TEMPERATURE INCREASE* | TENPERATURE RETENTION IN TEMPERATURE DECREASE** | DEFORMATION δ*** (mm) |
| 50 | PRESENT | PERFORMED | NOT PERFORMED | 1.2 |
| 50 | PRESENT | NOT PERFORMED | PERFORMED | 1.3 |
| 50 | PRESENT | PERFORMED | PERFORMED | 0.8 |

*: One-hour retention at 600° C.
**: One-hour retention at 250° C.
***: Deformation is the measured value δ shown in FIG. 3.

The results given in Table 8 shown above reveal that the temperature control and use of muffle in heat treatment can significantly reduce, the deformation δ of material caused by heat treatment.

(Experiment 5)

Figure 3:
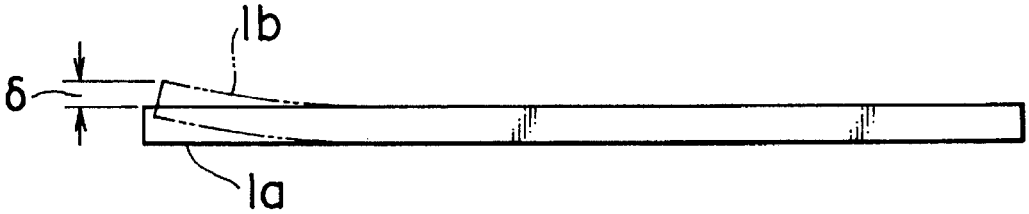
FIG. 3 is a view illustrating the amount of deformation of the test piece measured in the embodiment of the present invention.

Finally, to verify the effect of the aforesaid muffle for the welded material, TIG welding was performed on the material being tested under the same welding conditions as shown in FIG. 3. Then, the welded plate was cut into the same size as described above. The cut plate was put into the aforesaid muffle, which was put into a oil-burning heating furnace to perform the second solution treatment at 790° C. for 3 hours and the second aging treatment at 570° C. for 4 hours. In the heat treatment, temperature increasing and decreasing rates were controlled with a target rate of 50° C./hour. Further, subzero treatment was performed for caution's sake in cooling after the second solution treatment.

As a result, it was ascertained that for the material welded and heat treated in a muffle in accordance with the present invention, the deformation due to heat treatment is very low as shown in Table 8, and expected excellent mechanical properties were obtained as shown in Table 9 below.

(Observation of microstructure)

Figure 4:
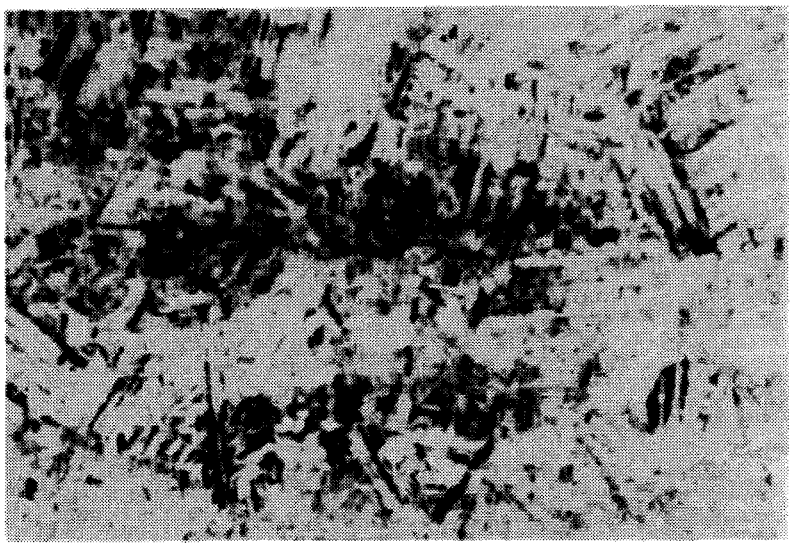
FIG. 4 is a sectional metallographic structure photograph obtained by an optical microscope.
Figure 5:
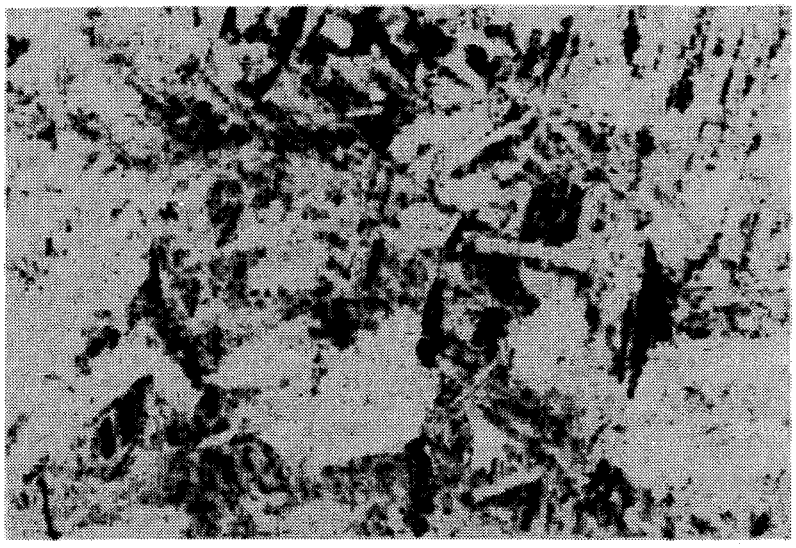
FIG. 5 is a sectional metallographic structure photograph obtained by an optical microscope.
Figure 6:
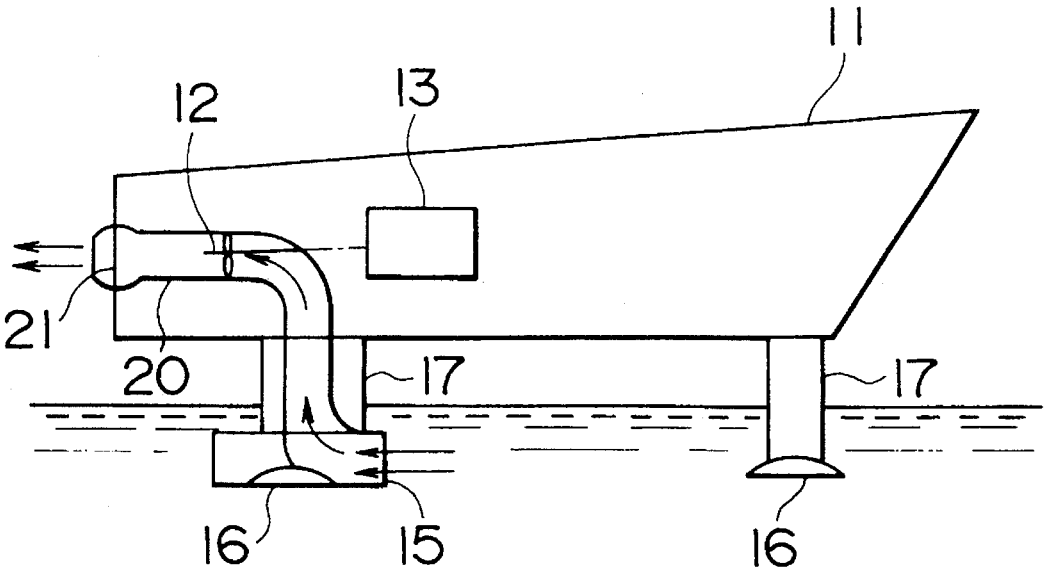
FIG. 6 is a schematic view of the construction of a hydrofoil ship.

The metallographic structure of this member was investigated. The metallographic structures obtained by means of an optical microscope are shown in FIG. 4 (100×) and FIG. 5 (300×). With an optical microscope, only martensitic phase was found as shorn in FIGS. 4 and 5. Further, the member was investigated by the X-ray diffraction method. As a result, it was ascertained that the material of the present invention contained reverted austenitic phase (γ) of over 6% as shown in Table 10 below. The reverted austenitic phase was formed finely in a part of the lath of martensite. Further, the observation by using an electron microscope revealed the precipitation of fine ε phase.

TABLE 9

| | 0.2% PROOF TEST (kgf/mm²) | TENSILE STRENGTH (kgf/mm²) | ELONGA-TION (%) | REDUCTION OF AREA (%) | IMPACT VALUE (kgf-m) | |
|---|---|---|---|---|---|---|
| | | | THIN-WALL PORTION | | | |
| BASE | 87.5 | 93.6 | 25.6 | 74.5 | BASE | 23.2 |
| METAL | 86.0 | 92.8 | 26.0 | 75.1 | METAL | 23.9 |
| WELDED | 88.0 | 94.0 | 21.6 | 73.7 | HAZ | 27.7 |
| JOINT | 89.0 | 94.4 | 19.6 | 73.4 | WELD METAL | 25.0 |
| | | | THICK-WALL PORTION | | | |
| BASE | 84.8 | 91.8 | 26.4 | 75.6 | BASE | 26.2 |
| METAL | 84.9 | 91.7 | 29.6 | 75.8 | METAL | 26.7 |
| WELDED | 86.8 | 92.6 | 21.6 | 75.3 | HAZ | 23.3 |
| | | | | | | 25.3 |
| JOINT | 86.5 | 92.3 | 22.0 | 74.4 | WELD METAL | 16.9 |
| | | | | | | 17.9 |

TABLE 10

| γ CONTENT IN MATERIAL (%) | 2ND SOLUTION TREATMENT TEMPERATURE (°C.) | 2ND SOLUTION TREATMENT γ CONTENT (%) | AGING TREATMENT TEMPERATURE (°C.) | AGING TREATMENT γ CONTENT (%) | AFTER SUBZERO TREATMENT (−70° C.) γ CONTENT (%) |
|---|---|---|---|---|---|
| | | BASE METAL | | | |
| AFTER 1ST | — | — | — | — | 5.2 |
| SOLUTION TREATMENT | 760 | 3.5 | 580 | 19.0 | — |
| AND AGING | 840 | 1.2 | 580 | 14.6 | — |
| TREATMENT 4.7 | 1040 | 0.5 | 600 | 9.2 | — |
| | | WELD METAL | | | |
| AFTER WELDING | 760 | 1.7 | 580 | 18.4 | 22.3 |
| 12.8 | 840 | 1.0 | 580 | 15.0 | |
| 14.5 | | | | 10.9* | 12.3 |

(Passenger craft)

An example of high-speed passenger craft to which the structural member of the present invention is applied will be described below with reference to FIGS. 6 through 9.

The passenger craft is provided with a wing 16 via a wing strut 17 at the fore and aft portions of the ship hull 11. The ship hull 11 has a water duct 20 which communicates with the aft wing strut 17. A pot type suction port 15 is disposed at the inlet end of the water duct 20 on the wing strut 17, while a jet nozzle is disposed at the end of the ship hull 11. Water flow is accelerated by a pump 12 installed in the water duct 20. The pump 12 is driven by a propulsion engine 13.

Figure 7:
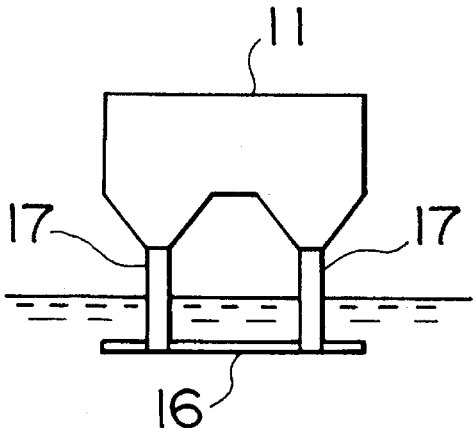
FIG. 7 is a front view of a hydrofoil ship.
Figure 8:
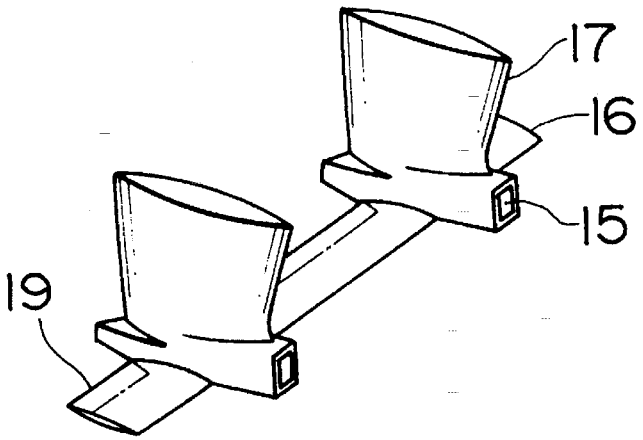
FIG. 8 is a perspective view of a forward wing.
Figure 9:
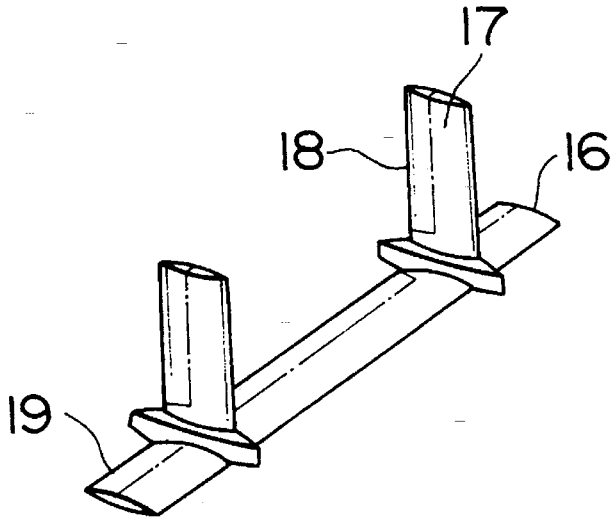
FIG. 9 is a perspective view of an aft wing.

As shown in FIG. 7, this embodiment provides a catamaran type hull. Two wing struts 17 are installed at each of fore and aft portions of the ship, and a wing is fixed by the pair of wing struts 17. The expanded views of forward and aft wings 16 and wing struts 17 are shown in FIGS. 8 and 9. The cross section of the wing 16 and the wing strut 17 is substantially of a lens shape or a streamline shape. The rear portion of the forward wing strut 17 constitutes a rudder flap 18, which allows the high-speed passenger craft to turn to the right or the left by rotating to the right or the left. The rear portion of the forward and aft wing 16 constitutes a flap 19, which controls the passenger craft vertically by rotating up or down.

The structural member produced by the same method as that described in Experiment 5 is used as the above wing 16. The structural member which is obtained by this method prevents the deformation during heat treatment and has high toughness, so that its use as the wing 16 gives high-speed passenger craft the following advantages:

(1) Conventionally, since the wing is long, any nonuniform deformation on the wing changes the pitch halfway along the length of wing, by which the lift generated becomes nonuniform. When nonuniform deformation is high, the lift may become in the reverse direction, so that there arises a trouble with the control of wing. The use of the wing having high uniformity in accordance with the present invention makes the pitch and lift uniform, by which the control of lift, namely, the vertical maneuverability of craft is improved.

(2) Conventionally, if the form of wing, which minimizes the fluid resistance in designing, becomes nonuniform, the fluid resistance increases. The use of the wing in accordance with the present invention can reduce the fluid resistance, thereby the propulsive efficiency being improved.

Next, another embodiment will be described below.

In this embodiment, as with the case of the above-described embodiment, by using the material being tested which has mechanical properties given in Table 1, TIG welding was first performed under the welding conditions given in Table 3 to obtain a welded joint.

Then, the second solution treatment (3 hours) and aging treatment (4 hours) shown in Table 11 below are performed on the welded joint. After the heat treatment, a mechanical property test was carried out. The test results are given in Table 11. The heat treatment was performed by giving a temperature change to the material to be heat-treated at a rate of 50° C./hour in both temperature increasing and decreasing processes. As seen from the test results, the test piece heat-treated in accordance with the present invention has the mechanical properties equivalent to those of the material.

TABLE 11

| 2ND SOLUTION TREATMENT (°C.) | AGING TREATMENT (°C.) | POSITION | NORMAL-TEMPERATURE TENSILE TEST 0.2% PROOF STRESS (kgf/mm²) | TENSILE STRESS (kgf/mm²) | ELONGATION (%) | REDUCTION OF AREA (%) | BREAKING POSITION | * INPACT VALUE (kgf/m) |
|---|---|---|---|---|---|---|---|---|
| 1040 | 560 | BASE | 110.6 | 115.5 | 18.9 | 65.5 | — | 11.8 |
| | | METAL | 110.3 | 114.9 | 19.9 | 68.9 | | 8.9 |
| | | WELDED | 115.4 | 126.3 | 20.8 | 64.3 | BASE METAL | 12.3 |
| | | JOINT | 114.9 | 127.9 | 21.2 | 62.2 | BASE METAL | 10.1 |
| | 580 | BASE | 105.1 | 108.5 | 18.7 | 66.9 | — | 14.8 |
| | | METAL | 104.5 | 107.2 | 19.6 | 68.1 | | 10.9 |
| | | WELDED | 110.2 | 115.8 | 17.3 | 66.5 | BASE METAL | 14.9 |
| | | JOINT | 111.3 | 116.1 | 18.9 | 65.3 | BASE METAL | 12.5 |
| | 600 | BASE | 99.4 | 104.9 | 22.2 | 67.9 | — | 17.0 |

TABLE 11-continued

| 2ND SOLUTION TREATMENT (°C.) | AGING TREAT-MENT (°C.) | POSITION | NORMAL-TEMPERATURE TENSILE TEST 0.2% PROOF STRESS (kgf/mm²) | TENSILE STRESS (kgf/mm²) | ELONGA-TION (%) | REDUC-TION OF AREA (%) | BREAKING POSITION | * INPACT VALUE (kgf/m) |
|---|---|---|---|---|---|---|---|---|
| | | METAL | 102.1 | 106.9 | 21.8 | 68.9 | | 17.6 |
| | | WELDED | 104.3 | 108.5 | 22.5 | 66.9 | BASE METAL | 16.6 |
| | | JOINT | 104.1 | 108.9 | 24.1 | 70.1 | BASE METAL | 17.6 |
| | MATERIAL | | 99.8 | 105.5 | 20.1 | 68.3 | — | 17.0 |
| | | | 97.6 | 104.3 | 21.2 | 64.1 | | 15.3 |

*: The impact test on weld was performed with a notch being formed on the Heat-affected zone (HAZ).

Further, the above-described material was formed into a plate measuring 3 m long, 50 cm wide, and 60 mm thick, and the plate was put into a 580 cm-wide, 4 m-high, and 25 mm-deep oil-burning heating furnace to perform the second solution treatment and aging treatment. The deformation was measured before and after the heat treatment. The measurement results are given in Table 12 below. A muffle in the table means a container formed of metal plates, as described above, an example of which is shown in FIG. 2. In FIG. 2, reference numeral 1 denotes a test piece (3 m in length, 50 cm in width, and 60 mm in thickness), 2 denotes a muffle made of JIS SUS304 stainless steel, 3 denotes a test piece holding jig, and 4 denotes a base.

TABLE 12

| | HEAT TREATMENT CONDITIONS TEMPERATURE INCREASING /DECREASING RATE (°C./hour) | MUFFLE | TEMPERATURE RETENTION IN TEMPERATURE INCREASE* | TENPERATURE RETENTION IN TEMPERATURE DECREASE** | DEFORMATION δ*** (mm) |
|---|---|---|---|---|---|
| REFERENCE HEAT | 150 | ABSENT | NOT PERFORMED | NOT PERFORMED | 10.2 |
| TREATMENT | 250 | ABSENT | NOT PERFORMED | NOT PERFORMED | 32.4 |
| HEAT | 50 | ABSENT | NOT PERFORMED | NOT PERFORMED | 5.8 |
| TREATMENT OF | 50 | ABSENT | PERFORMED | NOT PERFORMED | 3.4 |
| THE PRESENT | 50 | ABSENT | NOT PERFORMED | PERFORMED | 3.2 |
| INVENTION | 50 | ABSENT | PERFORMED | PERFORMED | 2.9 |
| | 50 | PRESENT | NOT PERFORMED | NOT PERFORMED | 2.4 |
| | 50 | PRESENT | PERFORMED | NOT PERFORMED | 2.1 |
| | 50 | PRESENT | NOT PERFORMED | PERFORMED | 2.3 |
| | 50 | PRESENT | PERFORMED | PERFORMED | 1.8 |

*: One-hour retention at 600° C.
**: One-hour retention at 250° C.
***: Deformation is the measured value δ shown in FIG. 3.

The measurement results reveal that the control of temperature and the use of muffle in heat treatment can significantly reduce the deformation due to heat treatment of material.

INDUSTRIAL APPLICABILITY

According to the structural member and the method of producing the same in accordance with the present invention, post-welding heat treatment of a large welded structural member, which cannot be performed by the conventional heat treatment method, can be performed. The producing method of the present invention provides uniform hardness distribution of the weld after heat treatment, and also high toughness which cannot be obtained by the conventional heat treatment method. In addition, the application of the present invention significantly reduces the deformation of material in heat treatment.

We claim:

1. A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing first aging treatment at a temperature not lower than 520° C. and not higher than 630° C; performing second solution treatment at 730° to 840° C.; and performing second aging treatment at a temperature not lower than 520° C. and not higher than 630° C.

2. A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing first aging treatment at a temperature not lower than 520° C. and not higher than 630° C.; fabricating a structural member of any shape by means of welding work; performing second solution treatment at 730° to 840° C.; and performing second aging treatment at a temperature not lower than 520° C. and not higher than 630° C.

3. A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing first aging treatment at a temperature not lower than 520° C. and not higher than 630° C.; heating the material at a rate of 100° C./hour or lower; performing second solution treatment at 730° to 840° C.; cooling the material in a furnace to room temperature at a cooling rate of 100° C./hour or lower; performing second aging treatment at a temperature not lower than 520° C. and not higher than 630° C.; and cooling the material in a furnace to room temperature at a cooling rate of 100° C./hour or lower.

4. A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing first aging treatment at a temperature not lower than 520° C. and not higher than 630° C.; fabricating a structural member of any shape by means of welding work; heating the material at a rate of 100° C./hour or lower; performing second solution treatment at 730° to 840° C.; cooling the material in a furnace to room temperature at a cooling rate of 100° C./hour or lower; performing second aging treatment at a temperature not lower than 520° C. and not higher than 630° C.; and cooling the material in a furnace to room temperature at a cooling rate of 100° C./hour or lower.

5. A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing first aging treatment at a temperature not lower than 520° C. and not higher than 630° C.; putting the material into a container formed of metal plates; heating the material together with the container at a rate of 100° C./hour or lower; performing second solution treatment at 730° to 840° C.; cooling the material in a furnace to room temperature at a cooling rate of 100° C./hour or lower; performing second aging treatment at a temperature not lower than 520° C. and not higher than 630° C.; and cooling the material in a furnace to room temperature at a cooling rate of 100° C./hour or lower.

6. A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing first aging treatment at a temperature not lower than 520° C. and not higher than 630° C.; fabricating a structural member of any shape by means of welding work; putting the material into a container formed of metal plates; heating the material together with the container at a rate of 100° C./hour or lower; performing second solution treatment at 730° to 840° C.; cooling the material in a furnace to room temperature at a cooling rate of 100° C./hour or lower; performing second aging treatment at a temperature not lower than 520° C. and not higher than 630° C.; and cooling the material in a furnace to room temperature at a cooling rate of 100° C./hour or lower.

7. A method of producing a structural member according to claim 3 wherein when the temperature of the material reaches a temperature between 550° C. and 620° C. in the temperature raising process in the second solution treatment, the material is kept at that temperature for 30 minutes to 2 hours, and after the temperatures at all portions of the material have been uniformed, the temperature is raised to the second solution treatment temperature.

8. A method of producing a structural member according claim 3 wherein when the temperature of the material reaches a temperature between 300° C. and 220° C. in the temperature lowering process in the second solution treatment, the material is kept at that temperature for 30 minutes to 2 hours, and after the temperatures at all portions of the material have been uniformed, the temperature is lowered to room temperature.

9. A method of producing a structural member according to claim 7 wherein when the temperature of the material reaches a temperature between 300° C. and 220° C. in the temperature lowering process in the second solution treatment, the material is kept at that temperature for 30 minutes to 2 hours, and after the temperatures at all portions of the material have been uniformed, the temperature is lowered to room temperature.

10. A method of producing a structural member comprising the steps of: performing first solution treatment at 1010° to 1050° C. on a stainless steel having a composition of 0.07%or less carbon, 1% or less silicon, 1% or less manganese, 2.5 to 5% copper, 3 to 5.5% nickel, 14 to 17.5% chromium, 0.5%or less molybdenum, 0.15 to 0.45% niobium, by weight, and the balance composed substantially of iron; performing aging treatment at a temperature not lower than 520° C. and not higher than 630° C.; fabricating a structural member of any shape by means of welding work; heating the material at a rate of 100° C./hour or lower; performing second solution treatment at 1010° to 1050° C.; cooling the material in a furnace to room temperature at a cooling rate of 100° C./hour or lower; performing aging treatment at a temperature not lower than 520° C. and not higher than 630° C.; and cooling the material in a furnace to room temperature at a cooling rate of 100° C./hour or lower.

11. A method of producing a structural member comprising the steps of: performing first solution treatment at 1010° to 1050° C. on a stainless steel having a composition of 0.07% or less carbon, 1% or less silicon, 1% or less manganese, 2.5 to 5% copper, 3 to 5.5% nickel, 14 to 17.5% chromium, 0.5% or less molybdenum, 0.15 to 0.45% niobium, by weight, and the balance composed substantially of iron; performing aging treatment at a temperature not lower than 520° C. and not higher than 630° C.; fabricating a structural member of any shape by means of welding work; putting the material into a container formed of metal plates; heating the material together with the container at a rate of 100° C./hour or lower; performing second solution treatment at 1010° to 1050° C.; cooling the material in a furnace to room temperature at a cooling rate of 100° C./hour or lower; performing aging treatment at a temperature not lower than 520° C. and not higher than 630° C.; and cooling the material in a furnace to room temperature at a cooling rate of 100° C./hour or lower.

12. A method of producing a structural member according to claim 10 wherein when the temperature of the material reaches a temperature between 550° C. and 620° C. in the temperature raising process in the second solution treatment, the material is kept at that temperature for 30 minutes to 2 hours, and after the temperatures at all portions of the material have been uniformed, the temperature is raised to the second solution treatment temperature.

13. A method of producing a structural member according to any one of claim 10 wherein when the temperature of the material reaches a temperature between 300° C. and 220° C. in the temperature lowering process in the second solution treatment, the material is kept at that temperature for 30 minutes to 2 hours, and after the temperatures at all portions of the material have been uniformed, the temperature is lowered to room temperature.

14. A method of producing a structural member according to claims 12 wherein when the temperature of the material reaches a temperature between 300° C. and 220° C. in the temperature lowering process in the second solution treatment, the material is kept at that temperature for 30 minutes to 2 hours, and after the temperatures at all portions of the material have been uniformed, the temperature is lowered to room temperature.

* * * * *